United States Patent [19]

Weiser et al.

[11] Patent Number: 4,827,234

[45] Date of Patent: May 2, 1989

[54] ELECTROMAGNETIC RELAY

[75] Inventors: Josef Weiser, Hohenschaeftlarn; Klaus Lueneburger, Berlin, both of Fed. Rep. of Germany

[73] Assignee: Siemens Aktiengesellschaft, Berlin and Munich, Fed. Rep. of Germany

[21] Appl. No.: 55,564

[22] Filed: May 28, 1987

[30] Foreign Application Priority Data

Jun. 23, 1986 [DE] Fed. Rep. of Germany ..... 3620974

[51] Int. Cl.[4] ..... H01F 7/08

[52] U.S. Cl. ..... 335/270; 335/273; 335/132

[58] Field of Search ..... 335/80, 81, 86, 128, 335/132, 270, 273, 274, 276, 279

[56] References Cited

U.S. PATENT DOCUMENTS

| | | | |
|---|---|---|---|
| 3,171,190 | 3/1965 | Zimmer | 335/279 X |
| 3,587,011 | 6/1971 | Kurz | 335/151 |
| 3,984,794 | 10/1976 | Beavitt | 335/154 |
| 4,031,493 | 6/1977 | Van Der Wielen | 335/132 X |
| 4,206,432 | 6/1980 | Altorfer et al. | 335/202 |
| 4,499,442 | 2/1985 | Kamo et al. | 335/81 X |
| 4,639,702 | 1/1987 | Sato | 335/81 X |

FOREIGN PATENT DOCUMENTS

| | | | |
|---|---|---|---|
| 2059390 | 6/1972 | Fed. Rep. of Germany | 335/151 |
| 2711480 | 9/1978 | Fed. Rep. of Germany | 335/128 |
| 1118574 | 7/1968 | United Kingdom | 335/151 |
| 1333968 | 10/1973 | United Kingdom | 335/151 |
| 2080031 | 1/1982 | United Kingdom | 335/128 |

*Primary Examiner*—George Harris
*Attorney, Agent, or Firm*—John Francis Moran

[57] ABSTRACT

A relay features two base-structured components (1 & 2) in the shape of half of a bowl having a winding (3) mounted on it. Two pole plates (6 & 7) are embedded in a common plane in one (2) of the base-structural components. The ends of the pole plates extend into a contact space (4 & 5). Paralleling the pole plates inside the contact space is a bridge armature (8) that is secured to a frame-shaped spring (9) in a plane coextensive with the separation between the two jointed base-structural components. The connection elements extend out of the sides of the base structure in the spool flanges and are bent down.

35 Claims, 3 Drawing Sheets

ELECTROMAGNETIC RELAY

BACKGROUND OF THE INVENTION

This invention relates to electromagnetic relays of the type wherein a contact space is completely enclosed in a base structure. More particularly, the invention relates to this type of relay wherein two flat pole plates are secured in a single plane in the base structure with their free ends separate and facing each other. A flat contact armature is typically accomodated on a resilient armature support in the contact space and bridges the free ends of the pole plates when the relay is excited.

A multiple contact for a relay of this type is disclosed in German patent document OS No. 2 059 390. This relay has a two-piece base structure. Several pairs of pole plates surrounded by glass frit are accomodated in one plane in one component of the housing. Associated with each pair of pole plates is an armature that is connected to one pole plate by a restoring spring. The multiple contact disclosed in that document, however, is hardly a complete relay because, for example, it lacks a coil winding and because the contact housing is not designed to accomodate a winding directly. Furthermore, the extensions of the contact elements project out of the face of the housing in the form of mutually opposing flux-conducting strips. When employed in a relay, consequently, they must first be additionally equipped with contacts. The disclosed device is therefore just a conventional reed-contact system, and any relay employing it would be less than optimal from the aspects of both size and cost. Since in addition the armature is directly connected to one of the pole plates, the potential applications for a switch of this type are limited, and conventional reed contacts of the type are, in particular, generally unsuitable for disconnecting or disrupting higher outputs.

SUMMARY OF THE INVENTION

An object of the present invention is to provide an improved relay of the foregoing type from the aspect that it may be manufactured from a few components of relatively simple design and in minimal number of steps.

Another object of the invention is to provide a high switching potential.

A related object is to provide a relay that may either be manufactured in the form of a bridge contact for switching high voltages or when necessary provided with an advance contact with no essential differences in design.

In accordance with the principles of the invention, a relay includes a base structure having a plastic spool form with flanges integrated into each end and with spool-connection elements secured in the flanges. At least one side of each pole plate has integrated connection elements that extend across its length in the vicinity of one spool flange, emerge laterally from the spool form in the same plane, and bend toward the connection side of the relay outside the spool form. Furthermore, the armature support according to the invention is in the form of a flat leaf spring that parallels the plane of the pole plates in the base structure. This armature is mounted on a section of the spring that extends into the contact space.

One preferred illustrative embodiment of the relay includes a two piece base structure, and the two components of base serve to define, in conjunction with mutually facing trough-shaped recesses, the contact space, whereby the two pole plates are secured in one of the two components of the base structure. The armature support in this illustrative embodiment is secured in the area that separates the two components.

All of the components in the relay in accordance with the invention that are readily constructed of flat sheet metal, with only the two pole plates having to be positioned, embedded or inserted for instance, in the base structure or in one of its components. The armature, which is in the form of a flat leaf, and the armature support, which is also flat, may be attached to each other before assembly, by welding for example. The armature support is inserted into the base structure or compressed between the two components of the base structure during assembly, with the armature maintaining the prescribed air gap or contact distance in relation to the two flat pole plates.

Clamping the armature separately and parallel to the pole plates retained within a recess serving as the armature support results in a bridge contact that is appropriate for disconnecting high voltages. The simply designed switching elements, specifically the pole plates and the armature, may be provided, by laser galvanization for instance, with contact coatings appropriate for switching powerful currents. Since a contact between the armature and one of the pole plates closes first, in any cases, when the armature is mounted as herein described, the system may also be designed and operated as an advance contact. In this case the pole plates are connected together electrically conductive, by means of a welded-on contact coating for example. Furthermore, the armature support in this embodiment is provided with its own connection element, which may, for example, be an integral part located laterally in the plane that separates the two components of the base structure. It is, however, also possible to secure a special connection element for the armature support in the second component of the base structure and to connect it, by spot welding for instance, to the armature support once the latter has been inserted.

The armature support in one preferred illustrative embodiment is in the form of a flat frame or frame component, secured in a continuous groove left between the two components of the base structure with the armature mounted on a projecting tongue inside the frame. The armature support in another embodiment may be a resilient strip tensioned at one end. It is also possible for the resilient strip to extend through the total contact space with each end secured in an appropriate groove left between both components of the base structure. The longitudinal displacement of the armature support may be limited by appropriate terminal walls in each groove in the base-structure components. It is, however, also possible to secure one end of the armature support either while the base-structure are being assembled together or by applying a plastic material later. The foregoing frame-shaped armature support may be secured on all sides between the two components of the base structure because the tongue, which projects inward only to approximately the center of the contact space, ensures that the armature will be able to move.

The armature support may have an adjusting web that projects out of the base structure and that can be used before the armature support if finally secured in place to displace it relative to the pole plates in order to establish the response and drop-off values of the relay within a desired range.

BRIEF DESCRIPTION OF THE DRAWING

Features of the invention and additional objects of the invention will be more readily appreciated and better understood by reference to the following detailed description which should be considered in conjunction with the drawing.

DETAILED DESCRIPTION

Figure 1:
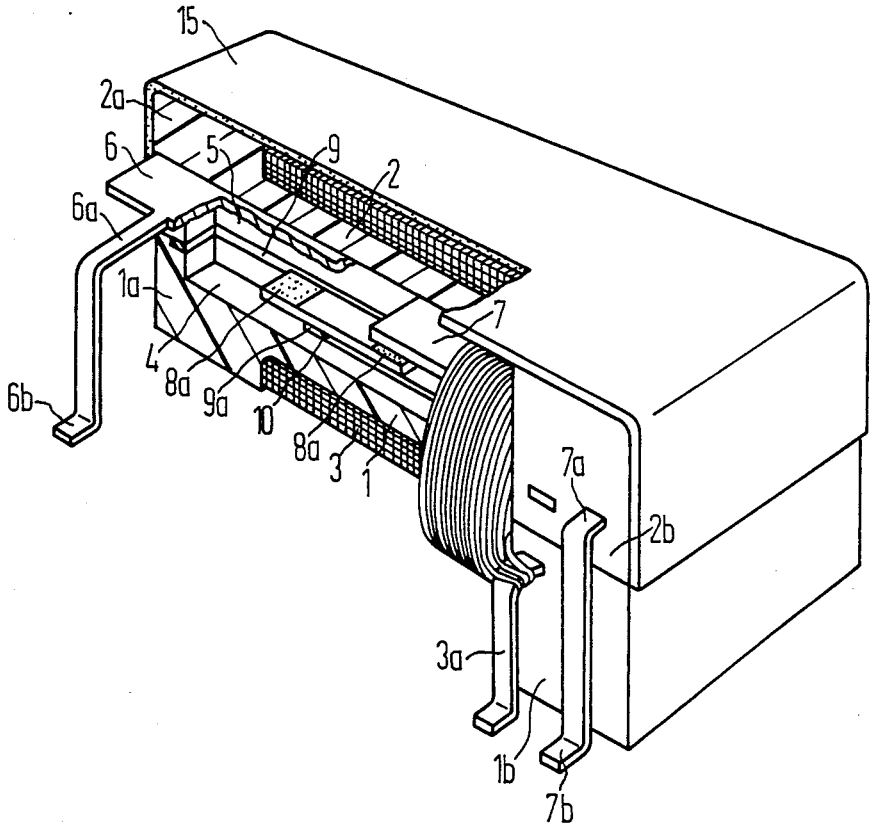
FIG. 1 illustrates a perspective view partially in sectional form of a relay in accordance with the invention.

In FIG. 1, the relay has a two-piece base structure, with both its bottom component 1 and its upper component 2 being shaped generally in the form of a half bowl and assembled to create a spool form that has a winding 3 mounted on it. Lower base-structure component 1 has a trough-shaped recess 4 and upper base-structure component 2 a similar trough-shaped recess 5. Both recesses define the contact space. Embedded in upper base-structure component 2 are two pole plates 6 and 7 with their free ends extending into contact space 4 and 5 and facing each other at a prescribed interval. Pole plates 6 and 7 may also be secured with their longitudinal edges in the walls of the contact space. They could also be plugged in instead of embedded.

Integrated into pole plate 6 in the vicinity of a flange 2*a* on base-structure component 2, at an angle to the length of the component, and in the same plane is a connection element 6*a* that is bent down at a right angle toward the relay's connection plane outside of the base structure. This element can be a conventional connection pin or may be shaped into a flat contact 6*b* as illustrated in FIG. 1. The relay will then be appropriate for surface mounting (SM). A similar contact 7*a* with a flat contact 7*b* is shaped form pole plate 7 in the vicinity of flange 2*b*. Similar connection elements 6*a* and 7*a* may be provided optionally or additionally on the opposite side of the relay. Contact with spool winding 3 is provided by a spool-contact pin 3*a* embedded in lower housing component 1 in each flange 1*a* and 1*b*. Pins 3*a*, similar to contact-connection elements 6*a* and 7*a*, may be provided on either or both sides of the relay as desired.

An armature 8 is accomodated in contact space regions 4 and 5 and secured parallel to both pole plates 6 and 7 and at a prescribed contact interval, constituting an area of overlap with the pole plates. When the relay is actuated, accordingly, armature 8 bridges both pole plates magnetically and electrically. It is for this purpose provided with a contact coating 8*a* in each area of overlap. Corresponding contact coatings are also applied to the pole plates. Armature 8 is secured by a frame-shaped armature support 9, which will be described later herein with reference to FIG. 2. Armature 8 is attached to armature support 9 by a spot weld 10. Other means of attachment, however, may be readily utilized.

Figure 2:
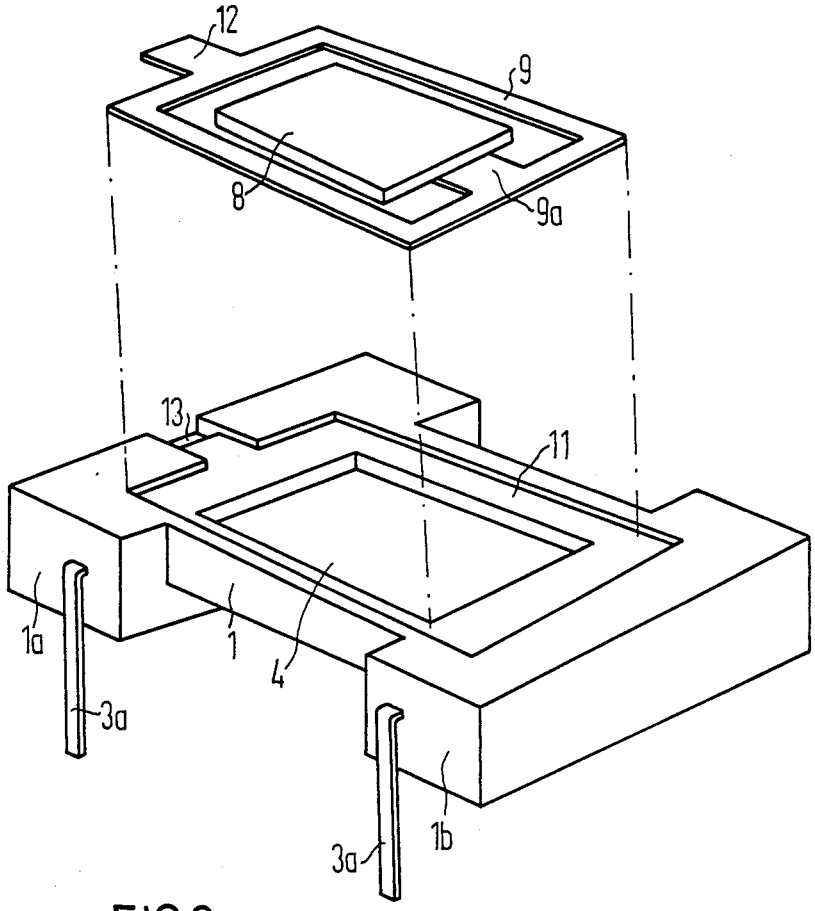
FIG. 2 depicts an armature support with the bottom of a base structure suitable for a relay in accordance with the illustration of FIG. 1.
Figure 4:
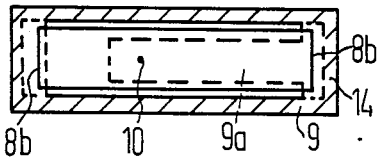

In FIG. 2, the design and disposition of armature support 9 in relation to part of the base is schematically illustrated. Trough-shaped recess 4, which constitutes the bottom of the contact space, is located in the mid-section of lower base component 1. Frame-shaped armature support 9 is accomodated in base component 1 in a frame-shaped offset or recess 11. The depth of offset 11 corresponds to approximately half the thickness of armature support 9, which is made out of a resilient material. In the interest of clarity of illustration both the height and width of offset 11 are exaggerated in FIG. 2. Since there is a corresponding offset in upper housing component 2, which is not illustrated in FIG. 4, a frame-shaped groove resides between the two housing components 1 and 2 when they are fitted together. This groove accomodates and secures armature support 9. A tongue 9*a*, which is what actually supports armature 8, extends in from one transverse web of frame 9.

When the offset 11 in base-structure components 1 and 2 is longer than the frame of armature support 9, as illustrated in FIG. 2, armature support 9 is able to still be displaced within the plane that is secured in even after the housing components have been fitted together, and the areas of the armature that face each pole plate 6 and 7 may be varied in order to calibrate the response sensitivity of the relay. To make is possible to slide armature support 9 back and forth, it includes an outwardly projecting adjusting web 12 at one end that can be activated externally from a corresponding recess 13 in base 1 or 2. Once the relay has been calibrated, opening 13 may be sealed off with a mass of molten material or suitable adhesive, for example, that simultaneously secures armature support 9 in place.

Figure 3:
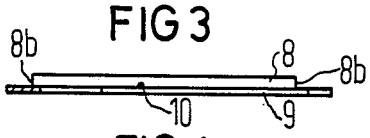
FIGS. 3 and 4 are a side and top view of another illustrative embodiment of an armature and armature support.

Another illustrative embodiment of armature support 9 and armature 8 is illustrated in FIGS. 3 and 4, again from the side and from the top. The armature support is again shaped like a frame with a tongue 9*a* extending inside the frame. The armature 8, in this case, is kept large enough to be approximately as wide as the frame section or contact space and slightly longer than the frame section of resilient armature support 9. Thus, with armature 8 at rest, both ends 8*a* rest lightly on the transverse webs of the frame-shaped support, securing the armature in a defined position. Since contact space 4 is also of course longer than the armature, the motion of the latter will not be restricted. The area 14 of armature support 9 that is clamped, or compressed, into the base structure is represented as the cross-hatched area in FIG. 4.

Figure 5:
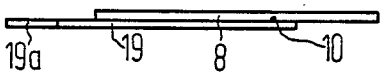
FIGS. 5 and 6 are another side and top view of a different version of an illustrative embodiment of an armature and armature support.
Figure 6:
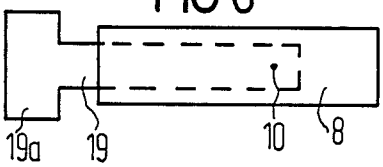

A further illustrative embodiment of the armature support in accordance with the invention is illustrated in FIGS. 5 and 6, also from the side and top views. Armature support 19 is in the form of a leaf spring tensioned at only one end. To improve the tension, the tensioned end 19*a* is in the shape of a T. It is secured in an appropriate groove, not shown, between the two base-structure components 1 and 2. The point of attachment between the armature and the armature support is in the form of a spot weld in this illustration as well. To ensure precise positioning of the armature and hence a specific response, it is also practical in this case to secure armature support 19 between both components 1 and 2 of the base structure.

The relay is simple to manufacture primarily due to the fact that all of its metal parts are flat stampings and do not have to be bent. The subsequent bending of connection elements 6*a*, 7*a*, and 3*a* outside the base can be ignored in this context. Pole plates 6 and 7 are accordingly injected in the form of flat stampings into upper housing component 2, whereas spool-connection elements 3*a* are injected into lower housing component 1. Once the trough-shaped recesses 4 and 5 in the two components have been cleaned out, the components are fitted together with armature support 9 or 19 and its welded-on armature 8 accomodated between them. Armature 8 is accordingly maintained at its prescribed contact distance, or spacing, from the pole plates just by fitting the two components together. A spool winding 3 may then be mounted, and the armature support adjusted to obtain calibration. The joint between the two housing components may then be sealed if desired. A flux return in the form of a ferromagnetic foil 15 is also wrapped around the upper housing component. A final extrusion-coating or immersion process may if deemed necessary secure the iron foil and spool and reliably seal off the inside.

In the described and illustrated embodiments, the armature functions as a bridge contact and according needs no connection of its own. Since in any case, however, the contact with one of the pole plates in this type of armature mount initially closes and one contact likewise initially opens, the relay may also be provided with either a proceeding contact or a consecutive contact. Practically no change in design will be necessary. The two pole plates 6 and 7 are simply connected electrically conductive by welding on a contact layer for example. The armature will in this case also need its own connection element, whereas one of the pole-plate connection elements can be eliminated. The armature-connection element may, for example, be injected into lower housing component 1, with an end projecting out of the inside connected to the armature support by welding for example. Contact coatings with different properties are then provided in a conventional manner between the armature and the pole plates to obtain a consecutive-contact system.

Powerful switching currents are possible in the relay described herein because appropriate contact coatings may be applied to the flat contact areas of the pole plates and armature. Mounting the armature in the foregoing manner results in a frictional motion along the contact surfaces that ensures a constant contact resistance. The unsymmetrical distribution of forces over the points of contact concurrently diminishes the risk of contact fusing as compared to other conventional bridge contacts. Since one contact always closes first, accompanied by decreasing oscillations, very short rebound times can be obtained.

Figure 7:
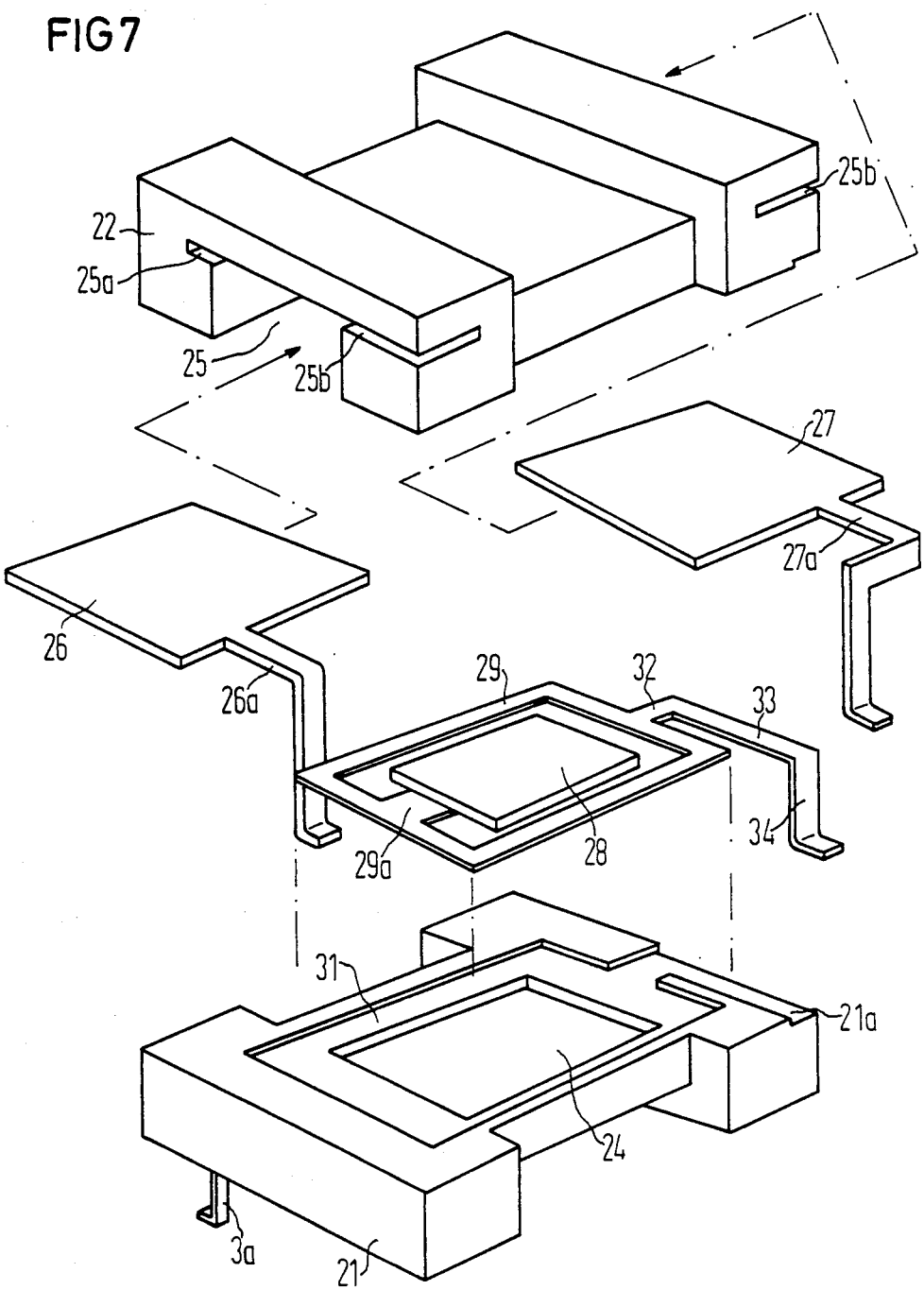
FIG. 7 depicts an exploded view of another illustrative embodiment of the invention similar to that of FIG. 2 wherein the pole plates are insertable and the armature support is provided.

In FIG. 7, the relay has a two-part base structure. The lower 21 part and upper 22 part of the two-part base structure are in the shape of half a bowl. Parts 21 and 22 are portions for assembly to create a spool that has a winding mounted on it as shown in FIG. 1. The lower portion 21 has a trough-shaped recess 24 and the upper portion 25 has a recess which opens towards the front. The lower portion 21 has almost exactly the same construction as base structure component 11 in FIG. 2. There is a frame-shaped recessed area 31 for receiving a frame-shaped armature support 29. The height of this offset is approximately half the thickness of the armature support which is made out of a resilient material. There is a corresponding offset on the under side of the upper portion 22 (not shown in the drawing) so that a frame-shaped groove is formed when the two portions 21 and 22 are fitted together. This groove accomodates the armature support 29. A tongue 29*a*, which supports the armature 28, extends inwards from one transverse web of the frame 29. Reference should be made to the description of FIG. 2 for further details and description of the armature and the armature support.

In contrast to FIG. 2, the adjusting web 32 of the armature support has an outwardly projecting extension 33 at right angles to the longitudinal axis of the relay. Formed at the end of this extension is a connecting lug 34 bent in a downward direction. This extension is accomodated in a corresponding recess 21*a* in the lower portion of the housing 21 and is therefore held fast when the lower 21 and upper 22 portions of the housing are fitted together. This additional connection element for the armature support enables the relay to have a double contact function or a sequential contact.

In the upper portion 22 of the housing, in the sides of recess 25, there are longitudinal grooves 25*a* and 25*b*. One pole plate 26 is inserted into these grooves from one side and another pole plate 27 is inserted from the other side. At right angles at the sides of these pole plates, there are corresponding connection elements 26*a* and 27*a* and these are bent in a downward direction at the side of the base structure similarly to connection elements 6*a* and 7*a* in FIG. 1. They are, therefore, located opposite to the spool contact pins 3*a*. Moreover, connection element 27*a* is bent again at the side of the relay to provide sufficient distance in relation to connection element 34 for the armature support.

The function of the relay according to FIG. 7 is the same as that described for the other illustrative embodiments. It should be noted that the insertable pole plates 26 and 27, as well as the connections 33/34, for the armature support may be used independently of one another or in combination with the previously described embodiments.

There has thus been shown and described novel relay configurations which fulfill all the objects and advantages sought therefor. Many changes, modifications, variations and other uses and applications of the subject invention will, however, become apparent to those skilled in the art after considering this specification and the accompanying drawing which disclose the preferred embodiments thereof. All such changes, modifications, variations and other uses and applications which do not depart from the spirit and scope of the invention are deemed to be covered by the invention which is limited only by the claims which follow.

We claim:

1. An electromagnetic relay having a contact space substantially enclosed in its base structure, the relay comprising:

(a) two flat pole plates secured in a single plane in the base structure having their free ends separate and facing each other, and a flat contact armature accomodated on a resilient armature support in the contact space and bridging the free ends of the pole plates when the relay is excited;

(b) the base structure being in the form of a plastic spool form including flanges integrated into each end and spool-connection elements secured in the flanges, at least one side of each pole plate having integrated connection elements that extend across its length in the vicinity of one spool flange, emerging laterally from the spool form in the same plane, and bent toward the connection side of the relay outside the spool form; and (c) the armature support is in the form of a flat leaf spring that parallels the plane of the pole plates in the base structure and the armature is mounted on a section of the spring that extends into the contact space.

2. A relay in accordance with claim 1, wherein a two-part base structure, the two components of which define, in conjunction with mutually facing trough-shaped recesses, the contact space, the two pole plates are secured in one of the two components of the base structure, and an area that separates the two components secures the armature support.

3. A relay in accordance with claim 1, wherein the armature support member is in the form of a flat frame secured in a continuous groove with the armature mounted on a projecting tongue inside the frame.

4. A relay in accordance with claim 1, wherein the armature support is a resilient strip tensioned at one end with the armature mounted on its free end.

5. A relay in accordance with claim 1, wherein the armature support is a resilient strip and extends through the total contact space with each end secured in an appropriate groove.

6. A relay in accordance with claim 1, wherein the pole plates are embedded in the base structure.

7. A relay in accordance with claim 1, wherein the pole plates are secured in insertion channels in the base structure.

8. A relay in accordance with claim 1, wherein the pole plates are positioned in the walls on each side of the contact space.

9. A relay in accordance with claim 1, wherein the armature constitutes in conjunction with the pole plates a consecutive contact, the pole plates are connected electrically conductive and the armature support also includes a connection element extending at an angle to the axis of the coil in the vicinity of one spool flange.

10. A relay in accordance with claim 2, wherein the armature support has an adjusting tab that extends longitudinally out of the area that separates the components of the base structure.

11. A relay in accordance with claim 2, wherein the armature support is a resilient strip tensioned at one end with the armature mounted on its free end.

12. A relay in accordance with claim 2, wherein the armature support is a resilient strip and extends through the total contact space with each end secured in an appropriate groove.

13. A relay in accordance with claim 2, wherein the pole plates are embedded in the base structure.

14. A relay in accordance with claim 2, wherein the armature constitutes in conjunction with the pole plates a consecutive contact, the pole plates are connected electrically conductive and the armature support is also provided an integrated connection element extending at an angle to the axis of the coil in the vicinity of one spool flange.

15. A relay in accordance with claim 2, wherein the armature support has an adjusting tab that extends longitudinally out of the area that separates the components of the base structure.

16. A relay in accordance with claim 2, wherein the pole plates are secured in insertion channels in one component of the base structure.

17. A relay in accordance with claim 2, wherein the pole plates are positioned in the walls on each side of the contact space.

18. A relay in accordance with claim 2, wherein the armature support member is in the form of a flat frame secured in a continuous groove with the armature mounted on a projecting tongue inside the frame.

19. A relay in accordance with claim 3, wherein the pole plates are embedded in one component of the base structure.

20. A relay in accordance with claim 3, wherein the pole plates are secured in insertion channels in the base structure.

21. A relay in accordance with claim 3, wherein the pole plates are positioned in the walls on each side of the contact space.

22. A relay in accordance with claim 3, wherein the armature constitutes in conjunction with the pole plates a consecutive contact, the pole plates are connected electrically conductive and the armature support is also provided with a connection element that is integrated in at an angle to the axis of the coil in the vicinity of one spool flange.

23. A relay in accordance with claim 3, wherein the armature support has an adjusting tab that extends longitudinally out of the area that separates the components of the base structure.

24. A relay in accordance with claim 4, wherein the armature is secured to the armature support away from a midpoint in relation to its length.

25. A relay in accordance with claim 4, wherein the pole plates are embedded in the base structure.

26. A relay in accordance with claim 5, wherein the pole plates are embedded in the base structure.

27. A relay in accordance with claim 5, wherein the pole plates are secured in insertion channels of the base structure.

28. A relay in accordance with claim 5, wherein the pole plates are positioned in the walls on each side of the contact space.

29. A relay in accordance with claim 5, wherein the armature support has an adjusting tab that extends longitudinally out of the area that separates the components of the base structure.

30. A relay in accordance with claim 7, wherein the pole plates are positioned in the walls on each side of the contact space.

31. A relay in accordance with claim 7, wherein the armature support has an adjusting tab that extends longitudinally out of the area that separates the components of the base structure.

32. A relay in accordance with claim 8, wherein the pole plates are secured in insertion channels in the base structure.

33. A relay in accordance with claim 8, wherein the armature support has an adjusting tab that extends longitudinally out of the area that separates the components of the base structure.

34. A relay in accordance with claim 10, wherein the pole plates are positioned in the walls on each side of the contact space.

35. A relay in accordance with claim 16, wherein the pole plates are positioned in the walls on each side of the contact space.

* * * * *